United States Patent [19]

Yu

[11] Patent Number: 4,641,815

[45] Date of Patent: Feb. 10, 1987

[54] HYDRAULIC JACK

[75] Inventor: Li K. Yu, Sanchung City, Taiwan

[73] Assignee: Fu-Chi Metalic Engineering Co. Ltd., Taipei Hsien, Taiwan

[21] Appl. No.: 873,345

[22] Filed: Jun. 12, 1986

[51] Int. Cl.[4] ..... B66F 3/24

[52] U.S. Cl. ..... 254/93 H

[58] Field of Search ..... 254/93 H, 93 R; 60/477; 92/108

[56] References Cited

U.S. PATENT DOCUMENTS 3,449,910 6/1969 Reynolds ..... 254/93 R
3,782,689 1/1974 Barosko ..... 254/93 R
4,357,798 11/1982 Hung ..... 60/477

FOREIGN PATENT DOCUMENTS 277432 11/1964 Netherlands ..... 254/93 R
586158 3/1977 Switzerland ..... 254/93 H

*Primary Examiner*—Robert C. Watson
*Attorney, Agent, or Firm*—Birch, Stewart, Kolasch & Birch

[57] ABSTRACT

A hydraulic jack includes a pump, a high pressure chamber, a low pressure chamber and a passage with a one-way valve communicating the high pressure chamber and the low pressure chamber. When a load is encountered, the high pressure chamber and the low pressure chamber are connected immediately through the passage through which the pump feeds the low pressure chamber to lift the load.

2 Claims, 1 Drawing Figure

HYDRAULIC JACK

BACKGROUND OF THE INVENTION

The invention relates to a hydraulic jack, particularly to a two-speed hydraulic jack which ascends at a high speed before a load is encountered and ascends at a lower speed after the load is encountered.

One conventional two-speed jack is shown in U.S. Pat. No. 3,782,689 of Barosko. The jack of Barosko includes a pump, a small-diameter high speed chamber, a low speed chamber and a sliding member disposed between the high and low speed chambers. In a illustrated embodiment, the sliding member acts as a combined valve and seal. It is found that the provision of such a sliding member has complicated the construction of the jack.

SUMMARY OF THE INVENTION

An object of the invention is to provide a simplified construction for the hydraulic jack of the type having a high speed chamber and a low speed chamber in which no sliding member is needed.

According to the invention, a hydraulic jack includes a base; a housing fixed on said base; a low pressure cylinder mounted upright securely in said housing defining a first working chamber; a ram cylinder slidably mounted in said first working chamber, said ram cylinder having a piston at a lower end thereof to define a low pressure working chamber with said first working chamber, and an axial central bore disposed within said ram cylinder for defining a second high pressure working chamber; an upright tube fixed on said base and extending into said bore, said tube being in communication with said high pressure working chamber, and improvements wherein said ram cylinder includes an outer hollow cylinder, an inner hollow cylinder fixed coaxially in said outer hollow cylinder and a ram sleeve axially mounted in said outer hollow cylinder around the upper portion of said inner hollow cylinder and extending out from the top of said outer cylinder, said inner hollow cylinder defining said second high pressure working chamber and receiving said upright tube; wherein said inner hollow cylinder is greater slightly in diameter than said upright tube, and has a top flat closed end, said second high pressure working chamber is shut off sealingly by the piston and the upright tube from said low pressure chamber, and said base has a passage communicating said tube and said low pressure chamber, and a one-way valve, such as a spring-urged ball check valve, provided in said passage, whereby said low pressure chamber and said high pressure chamber are interconnected through said passage and said valve when a load is encountered.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
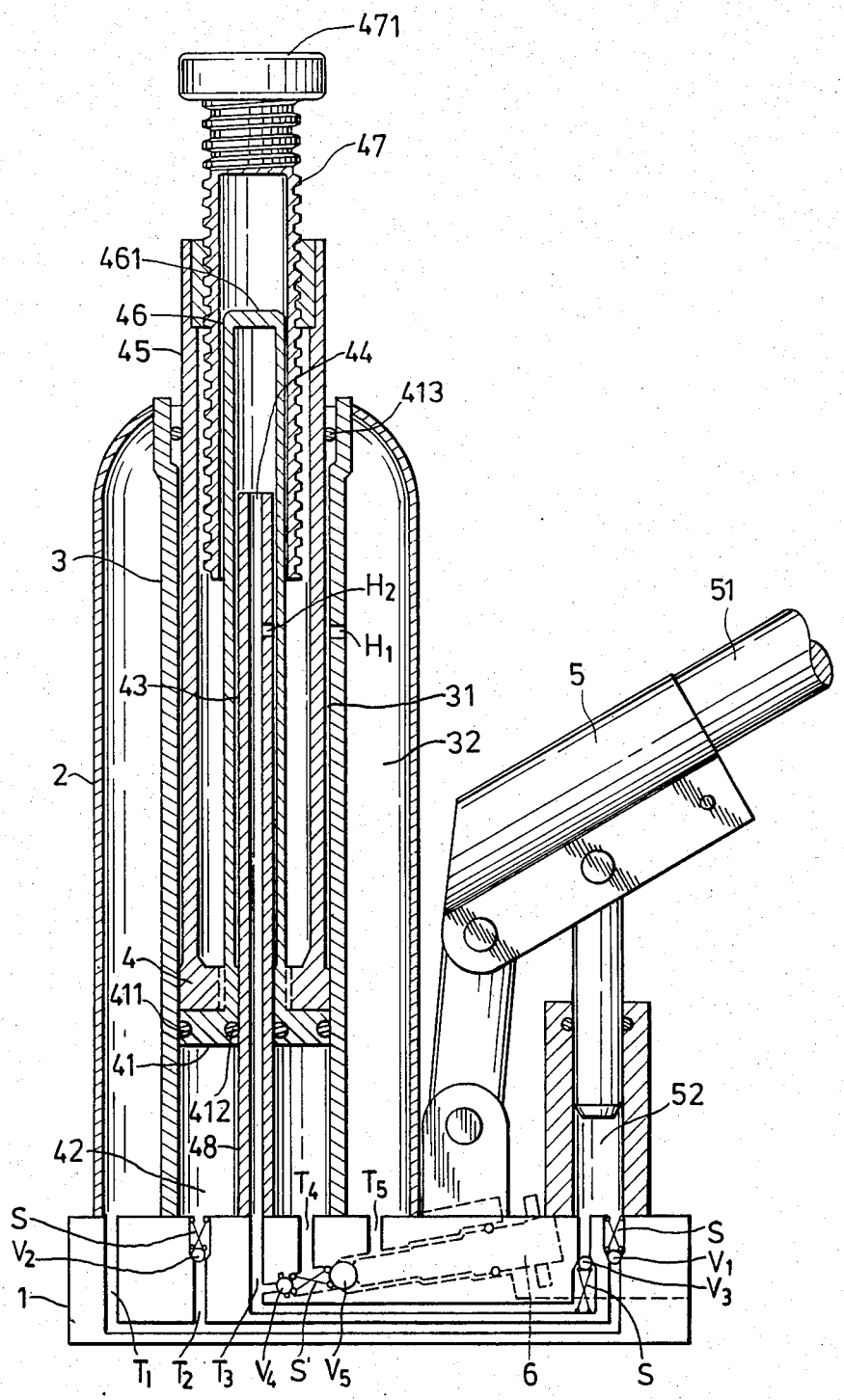
FIG. 1 is a longitudinal section showing a hydraulic jack according to the invention.

Referring to FIG. 1, there is a hydraulic jack including a base 1; a housing 2 fixed on the base 1; low pressure cylinder 3, mounted upright securely in the housing 2, having a first radial release passage H1, defining internally a first working chamber 31 and defining externally a reservoir 32 within said housing 2; a ram cylinder 4 slidably mounted in the first working chamber 31, the ram cylinder 4 including a piston 41 with a first O ring 411 and a second O ring 412 at its lower end to define a low pressure working chamber 42 below the piston 41 in the first working chamber 31; an axial central bore 43 internally defining a second high pressure working chamber 44; an outer hollow cylinder 45; an inner hollow cylinder 46 fixed coaxially in the outer hollow cylinder 45 and having a top flat closed end 461; and a ram sleeve 47 axially mounted in the outer hollow cylinder 45 around the upper portion of the inner hollow cylinder 46; an upright tube 48 fixed on the base and extending into the bore 43 and having a diameter slightly smaller than that of the inner hollow cylinder 46 to engage with the same so as to define the second high pressure working chamber 44 and to permit the second high pressure working chamber 44 to be shut off sealingly from the low pressure chamber 42, the upright tube 48 further having a second radial release passage H2 at the same level as the first radial release passage H1; and a pump 5 including a pump handle 51 and a pump chamber 52; wherein the ram sleeve 47 extends out from the top of the outer cylinder 45 and has a flat top surface 471 for lifting a load, such as a floor panel of a vehicle to be repaired.

Preferably, the top of the clearance between the low pressure cylinder 3 and the outer hollow cylinder 45 is sealed by a third O ring 413.

In the embodiment, there are five passages for hydraulic oil, including a first passage T1 with a first ball check valve V1 for communicating the pump chamber 52 and the reservoir 32, a second passage T2 with a second ball check valve V2 for communicating the the first passage T1 and the low pressure chamber 42, a third passage T3 with a third ball check valve V3 for communicating the pump chamber 52 and the high pressure chamber 44, a fourth passage T4 with a fourth ball check valve V4 for communicating the third passage T3 and the low pressure chamber 42, and a fifth passage T5 with a fifth ball check valve V5 for communicating the fourth passage T4 and the reservoir 32. Each of the valves V1, V2, V3, V4 and V5 is urged by a spring S except that the fourth valve V4 and the fifth valve V5 are both urged by a single spring S'. Thus, the fourth and fifth valves V4, V5 are controlled only by a normally closed release rotary knob 6.

In operation, when the pump handle 51 is pulled upward, the oil in the reservoir 32 is drawn into the pump chamber 52 through the first passage T1 and first valve V1. Then, when the pump handle 51 is pushed downward, the oil which has been drawn into the pump chamber 52 is fed to the high pressure chamber 44 through the third passage T3 and the third valve V3. Since the diameter of the inner hollow cylinder 46 and the upright tube 48 is small, the ram sleeve 47 can ascends at a high speed before a load is encountered.

At the same time, when the ram cylinder 47 carrying the piston 41 is moved upward, the piston 41 will draw the oil within the reservoir 32 into the low pressure chamber 42 formed below the piston 41 through the second passage T2 and the second valve V2, due to the negative pressure effect of the low pressure chamber 42 relative to the reservoir 32, so the low pressure chamber 42 will always be filled with the oil.

When the load is encountered, because the oil pressure in the high pressure chamber 44 is insufficient to lift the load and the oil pressure in the third passage T3 is enough to overcome the pressure of the compression spring S, subsequent pushing movement of the pump handle 51 will cause the oil to be fed to the low pressure chamber 42 from the pump chamber 52 through the fourth passage T4 and the fourth valve V4, due to the connection between the high pressure chamber 44 and the low pressure chamber 42, so that the oil filled in the low pressure chamber 42 will lift the load upwardly.

Finally, because of the negative pressure effect, when the use of the hydraulic jack is completed and it is desired to lower the load and restore the pump to an idle condition, it is necessary only to loosen the knob 6 to open the fourth valve V4 and the fifth valve V5 so that the oil filled in the high pressure chamber 44 will be squeezed by the load to return to the reservoir 32 through the third passage T3, the fourth valve V4, the fifth valve V5 and the fifth passage T5, and the oil filled in the low pressure chamber 42 will be squeezed to return to the reservoir 32 through the fourth passage T4, the fifth valve V5 and the fifth passage T5.

It is further noted that the first and second radial relief passage H1, H2 are provided for preventing overstressing.

With the invention thus explained, it is apparent that various modifications and variations can be made without departing from the scope of the invention. It is therefore intended that the invention be limited as indicated in the appended claims.

What is claimed is:

1. A hydraulic jack comprising a base; a housing fixed on said base; a low pressure cylinder mounted upright securely in said housing defining a first working chamber; a ram cylinder slidably mounted in said first working camber, said ram cylinder having a piston at a lower end thereof to define a low pressure working chamber with said first working chamber, and an axial central bore defining a second high pressure working chamber; an upright tube fixed on said base and extending into said bore, said tube being communicated with said high pressure working chamber; and improvements wherein said ram cylinder includes an outer hollow cylinder and an inner hollow cylinder fixed coaxially in said outer hollow cylinder, said inner hollow cylinder defining said second high pressure working chamber and receiving said tube, said inner cylinder being greater slightly in diameter than said tube, and having a top flat closed end, said second high pressure chamber being shut off sealingly by said piston and said upright tube from said low pressure chamber, and said base having a passage means communicating said tube and said low pressure chamber, and a one-way valve in said passage, whereby said low pressure chamber and said high pressure chamber are interconnected through said passage when a load is encountered.

2. A hydraulic jack as claimed in claim 1, wherein said ram cylinder further includes a ram sleeve axially mounted in said outer cylinder around the upper portion of said inner cylinder, said ram sleeve extending out from the top of said outer cylinder.

* * * * *